US011663964B2

(12) United States Patent
Yin et al.

(10) Patent No.: US 11,663,964 B2
(45) Date of Patent: May 30, 2023

(54) DISPLAY PANEL

(71) Applicant: Wuhan China Star Optoelectronics Semiconductor Display Technology Co., Ltd., Hubei (CN)

(72) Inventors: Maojun Yin, Hubei (CN); Jiayao Yang, Hubei (CN); Feixiang Sun, Hubei (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 53 days.

(21) Appl. No.: 17/261,622

(22) PCT Filed: Jul. 9, 2020

(86) PCT No.: PCT/CN2020/100993
§ 371 (c)(1),
(2) Date: Jan. 20, 2021

(87) PCT Pub. No.: WO2021/253528
PCT Pub. Date: Dec. 23, 2021

(65) Prior Publication Data

US 2022/0189388 A1 Jun. 16, 2022

(30) Foreign Application Priority Data

Jun. 16, 2020 (CN) ..... 202010547213.1

(51) Int. Cl.
*G09G 3/3208* (2016.01)
*G09G 3/00* (2006.01)

(52) U.S. Cl.
CPC ..... *G09G 3/3208* (2013.01); *G09G 3/035* (2020.08); *G09G 2300/0408* (2013.01); *G09G 2320/0252* (2013.01)

(58) Field of Classification Search
None
See application file for complete search history.

(56) References Cited

U.S. PATENT DOCUMENTS

| | | | | |
|---|---|---|---|---|
| 9,847,054 | B2 | 12/2017 | Hwang et al. | |
| 11,069,266 | B1 * | 7/2021 | Wu | G09G 3/006 |
| 2014/0118221 | A1 * | 5/2014 | Park | G02F 1/1345 345/1.3 |
| 2015/0022515 | A1 * | 1/2015 | Ikeda | G09G 3/3233 345/212 |
| 2016/0372078 | A1 | 12/2016 | Song et al. | |
| 2017/0031389 | A1 * | 2/2017 | Yoo | G09G 3/035 |

(Continued)

FOREIGN PATENT DOCUMENTS

| | | |
|---|---|---|
| CN | 104658466 | 5/2015 |
| CN | 104933964 | 9/2015 |

(Continued)

*Primary Examiner* — Benjamin C Lee
*Assistant Examiner* — Emily J Frank

(57) ABSTRACT

A display panel comprises two driver modules, each of which is provided with a driver chip in a first direction. Each driver chip drives a portion of a GOA circuit in a second direction. That is, a first driver chip drives a first GOA circuit, and a second driver chip drives a second GOA circuit. The first GOA circuit and the second GOA circuit are disconnected at a particular location on the display panel.

18 Claims, 4 Drawing Sheets

(56) References Cited

U.S. PATENT DOCUMENTS

| | | | | |
|---|---|---|---|---|
| 2017/0186400 | A1 | 6/2017 | Song et al. | |
| 2018/0211619 | A1* | 7/2018 | Ma | G06F 3/0412 |
| 2018/0322848 | A1* | 11/2018 | Wu | G09G 3/3666 |
| 2019/0130840 | A1 | 5/2019 | Park et al. | |
| 2019/0140198 | A1* | 5/2019 | Li | H01L 27/1218 |
| 2019/0189067 | A1 | 6/2019 | Li | |
| 2020/0004295 | A1* | 1/2020 | Paek | G06F 1/1641 |
| 2021/0303121 | A1* | 9/2021 | Ku | G06F 3/0446 |
| 2021/0390892 | A1* | 12/2021 | Lee | G09G 5/10 |

FOREIGN PATENT DOCUMENTS

| | | |
|---|---|---|
| CN | 106652929 | 5/2017 |
| CN | 207134125 | 3/2018 |
| CN | 108109598 | 6/2018 |
| CN | 109345956 | 2/2019 |
| CN | 109637477 | 4/2019 |
| CN | 109686333 | 4/2019 |
| CN | 109817143 | 5/2019 |
| CN | 111243485 | 6/2020 |

* cited by examiner

DISPLAY PANEL

RELATED APPLICATIONS

This application is a National Phase of PCT Patent Application No. PCT/CN2020/100993 having International filing date of Jul. 9, 2020, which claims the benefit of priority of Chinese Patent Application No. 202010547213.1 filed on Jun. 16, 2020. The contents of the above applications are all incorporated by reference as if fully set forth herein in their entirety.

FIELD AND BACKGROUND OF THE INVENTION

The present invention relates to a technical field of display technologies, and more particularly, to a display panel.

As electronic products become more intelligent, organic light-emitting diode (OLED) display panels are increasingly made larger in sizes and have diversified appearances.

Electronic products with active-matrix organic light-emitting diode (AMOLED) curved displays have also emerged in consumer markets. As the AMOLED curved displays have a larger size and more complex bendable structures, driving mechanism for the AMOLED curved displays also has higher requirements to ensure display quality.

As shown in FIG. 1, when a current flexible display panel 1' operates normally, a driving signal output from a driver chip 11' is input to a gate driver on array (GOA) circuit 12' at one end of the panel to drive a first stage GOA circuit to work, and is then transmitted to a next stage GOA. However, a large-size flexible and bendable display incurs a long transmission distance and delay during transmission of the driving signal, which exhibits substantial signal deformation between the first stage GOA and a last stage GOA, and leads to reduced display quality of the display panel and abnormal display screens. Additionally, as a number of display lines increases, screen refresh time is also longer, and a high refresh rate is infeasible.

Consequently, outstanding problems in current AMOLED display panel technology include long transmission distances and driving signal propagation delay due to the large size of the flexible and bendable display, resulting in substantial signal deformation between the first stage GOA and the last stage GOA, which leads to reduced display quality and abnormalities of the display panel, as well as prolonged display refresh time with an increased number of display lines, which makes it difficult to achieve a high refresh rate. Improvements to address these problems are needed.

The application relates to a display panel used to address the problems in current technology, including long transmission distances and driving signal propagation delay due to the large size of the flexible and bendable display, resulting in substantial signal deformation between the first stage GOA and the last stage GOA, which leads to reduced display quality and abnormalities of the display panel, as well as prolonged display refresh time with an increased number of display lines, which makes it difficult to achieve a high refresh rate.

SUMMARY OF THE INVENTION

To address the above issues, the technical solutions provided in this application are as follows:

The application provides a display panel, wherein the display panel comprises two driver modules, each of which is provided with a driver chip in a first direction, each driver chip drives a portion of a GOA circuit in a second direction, wherein a first driver chip drives a first GOA circuit, and a second driver chip drives a second GOA circuit, the first GOA circuit and the second GOA circuit are disconnected at a particular location on the display panel, wherein the first driver chip, the second driver chip, and the display panel are packaged using a COP or COF process.

According to an embodiment of the application, the second direction is perpendicular to the first direction.

According to an embodiment of the application, the first driver module and the second driver module share a same data line.

According to an embodiment of the application, the first driver module and the second driver module respectively drive the first GOA circuit and the second GOA circuit along the second direction, which serve as first stages for input of driving signals, and the first GOA circuit and the second GOA circuit are located close to one end of the first driver chip and the second driver chip, wherein a first stage GOA to which the first GOA circuit inputs a driving signal is close to the first driver chip, and a first stage GOA to which the second GOA circuit inputs a driving signal is close to the second driver chip.

According to an embodiment of the application, the first GOA circuit and the second GOA circuit are disconnected at a central axis of the display panel with respect to the second direction, wherein an area of the first driver module is equal to an area of the second driver module.

According to an embodiment of the application, the display panel is divided into a bending zone and a non-bending zone, the first GOA circuit and the second GOA circuit are disconnected at a location of the bending zone of the display panel in the second direction, wherein an area of the first driver module is not equal to an area of the second driver module.

According to an embodiment of the application, the location where the first GOA circuit and the second GOA circuit are disconnected in the second direction is close to the first driver chip, wherein the area of the first driver module is less than the area of the second driver module.

According to an embodiment of the application, the location where the first GOA circuit and the second GOA circuit are disconnected in the second direction is close to the second driver chip, wherein the area of the first driver module is greater than the area of the second driver module.

According to an embodiment of the application, the first driver module and the second driver module respectively drive the first GOA circuit and the second GOA circuit along the second direction, which serve as first stages for input of the driving signals, and the first GOA circuit and the second GOA circuit are located away from one end of the first driver chip and the second driver chip, wherein a first stage GOA to which the first GOA circuit inputs a driving signal is away from the first driver chip, and a first stage GOA to which the second GOA circuit inputs a driving signal is away from the second driver chip.

According to an embodiment of the application, the first driver module includes at least one first virtual GOA circuit which is connected in series and located close to the location where the first GOA circuit and the second GOA circuit are disconnected, the second driver module includes at least one second virtual GOA circuit which is connected in series and located close to the location where the first GOA circuit and the second GOA circuit are disconnected.

The application provides a display panel, wherein the display panel comprises two driver modules, each of which is provided with a driver chip in a first direction, each driver chip drives a portion of a GOA circuit in a second direction, wherein a first driver chip drives a first GOA circuit, and a second driver chip drives a second GOA circuit, the first GOA circuit and the second GOA circuit are disconnected at a particular location on the display panel.

According to an embodiment of the application, the second direction is perpendicular to the first direction.

According to an embodiment of the application, the first driver module and the second driver module share a same data line.

According to an embodiment of the application, the first driver module and the second driver module respectively drive the first GOA circuit and the second GOA circuit along the second direction, which serve as first stages for input of driving signals, and the first GOA circuit and the second GOA circuit are located close to one end of the first driver chip and the second driver chip, wherein a first stage GOA to which the first GOA circuit inputs a driving signal is close to the first driver chip, and a first stage GOA to which the second GOA circuit inputs a driving signal is close to the second driver chip.

According to an embodiment of the application, the first GOA circuit and the second GOA circuit are disconnected at a central axis of the display panel with respect to the second direction, wherein an area of the first driver module is equal to an area of the second driver module.

According to an embodiment of the application, the display panel is divided into a bending zone and a non-bending zone, the first GOA circuit and the second GOA circuit are disconnected at a location of the bending zone of the display panel in the second direction, wherein an area of the first driver module is not equal to an area of the second driver module.

According to an embodiment of the application, the location where the first GOA circuit and the second GOA circuit are disconnected in the second direction is close to the first driver chip, wherein the area of the first driver module is less than the area of the second driver module.

According to an embodiment of the application, the location where the first GOA circuit and the second GOA circuit are disconnected in the second direction is close to the second driver chip, wherein the area of the first driver module is greater than the area of the second driver module.

According to an embodiment of the application, the first driver module and the second driver module respectively drive the first GOA circuit and the second GOA circuit along the second direction, which serve as first stages for input of driving signals, and the first GOA circuit and the second GOA circuit are located away from one end of the first driver chip and the second driver chip, wherein a first stage GOA to which the first GOA circuit inputs a driving signal is away from the first driver chip, and a first stage GOA to which the second GOA circuit inputs a driving signal is away from the second driver chip.

According to an embodiment of the application, the first driver module includes at least one first virtual GOA circuit which is connected in series and located close to the location where the first GOA circuit and the second GOA circuit are disconnected, the second driver module includes at least one second virtual GOA circuit which is connected in series and located close to the location where the first GOA circuit and the second GOA circuit are disconnected.

Compared with current technologies, a display panel provided in this application has the following beneficial effects:

1. The application provides a display panel comprising two driver modules, each of which is provided with a driver chip in a first direction. Each driver chip drives a portion of a GOA circuit in a second direction, wherein a first driver chip drives a first GOA circuit, and a second driver chip drives a second GOA circuit. The first GOA circuit and the second GOA circuit are disconnected at a particular location on the display panel. The display has an increased number of display lines while reducing the influence of signal delay on the display screen, and can achieve a high screen refresh rate and improve display quality.

2. The application provides a display panel, wherein the first GOA circuit and the second GOA circuit are disconnected at a central axis of the display panel with respect to the second direction, or at a location in the bending zone of the display panel in the second direction. Better display quality at a disconnect area of the display panel is obtained without affecting normal operation of the display.

3. The application provides a display panel, which includes the first driver module and the second driver module. Additionally, the first driver module and the second driver module respectively drive the first GOA circuit and the second GOA circuit along the second direction, which serve as first stages for input of driving signals, and the first GOA circuit and the second GOA circuit are located away from one end of the first driver chip and the second driver chip, wherein a first stage GOA to which the first GOA circuit inputs a driving signal is away from the first driver chip, and a first stage GOA to which the second GOA circuit inputs a driving signal is away from the second driver chip. The first stage GOA for receiving a driving signal input at the disconnect area of the first driver module and the second driver module can reduce signal deformation between the two modules to prevent display abnormalities in the area where the GOA is disconnected, and to prevent distortion of GOA signals in the disconnect area after the GOA signals have undergone transmission in a cascade of the stages.

4. Further, the application provides a display panel with a number of virtual GOA circuits being provided at the disconnect area of the first driver module and the second driver module. The virtual GOA circuits are connected in series with the first GOA circuit in the first driver module and the second GOA circuit in the second driver module, respectively, to increase load on the signal line, further stabilize the driving signals, reduce the difference between the driving signals, and prevent display abnormalities in the GOA disconnect area.

BRIEF DESCRIPTION OF THE SEVERAL VIEWS OF THE DRAWINGS

To clear disclose the technical solution of the embodiments according to the present method, a brief description of the drawings that are necessary for the illustration of the embodiments will be given as follows. Apparently, the drawings described below show only example embodiments of the present method and for those having ordinary skills in the art, other drawings may be easily obtained from these drawings without paying any creative effort.

DESCRIPTION OF SPECIFIC EMBODIMENTS OF THE INVENTION

Figure 1:
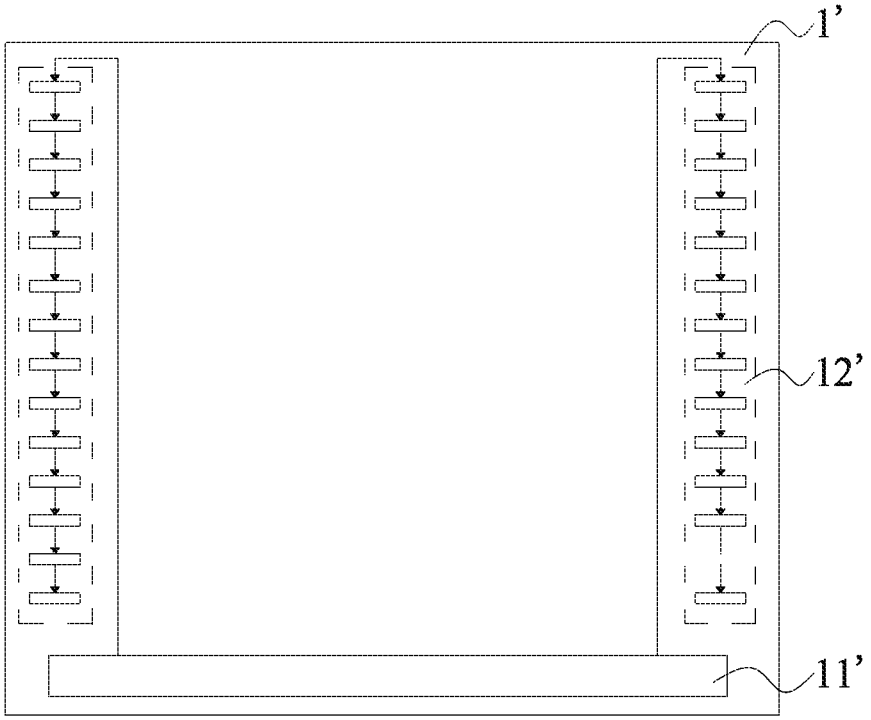
(Prior Art) FIG. 1
FIG. 1 is a structural schematic diagram showing a display panel of current technology.

The following is a clear and comprehensive description of the technical solutions in the embodiments of this application with reference to the drawings in the embodiments of the application. Obviously, the embodiments described are only part of this application, not for exhaustive illustration. Based on the embodiments of the application, other embodiments which may be easily obtained by those having ordinary skills in the art without paying additional creative effort fall within the scope of the application for protection.

In the description of the application, it is to be understood that directions or position relationships indicated by terms "center", "longitudinal", "transverse", "length", "width". "thickness", "top", "bottom", "front", "back", "left", "right", "vertical", "horizontal", "top", "bottom", "inside", "outside", "clockwise", "counterclockwise", and the similar are based on orientation or positional relationship shown in the drawings, and are intended only to facilitate description of the application and simplify the description, and are not intended to indicate or imply that the device or component referred to must have a particular orientation, or be constructed or operated in a particular orientation, and are therefore not to be construed as limitations on the application. Moreover, the terms "first" and "second" are used for descriptive purposes only and are not to be understood as indicating or implying relative importance or the number of technical features indicated. Thus, a feature that is denoted by "first" or "second" may expressly or implicitly include one or more of the same features. In the description of the application, "more than one" means two or more, unless otherwise expressly and specifically indicated.

The application provides a display panel, which is to be detailed with reference to FIG. 2 to FIG. 8.

When a current flexible display panel operates normally, a driving signal sent from a driver chip is input to a gate driver on array (GOA) circuit at one end of the panel, drives a first stage GOA circuit to work, and is subsequently transmitted to a next stage GOA. However, due to the large size of the flexible and bendable display and the long transmission distance, the driving signal suffers from propagation delay in transmission. This can lead to a great signal deformation between the first stage GOA and the last stage GOA, which causes reduced display quality and abnormalities of the display panel. With the increasing number of display lines, the time required to refresh a frame of display screen also becomes longer, and it is difficult to achieve a high refresh rate. Therefore, the application provides a display panel to address the above issues.

Figure 2:
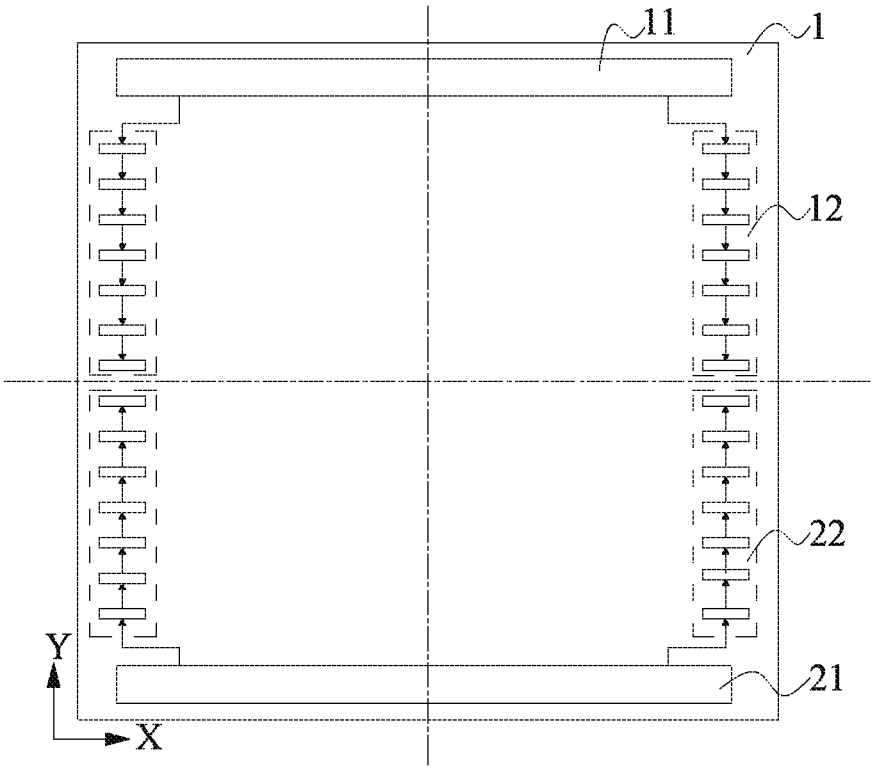
FIG. 2 is a first schematic diagram showing a structure of a display panel according to an embodiment of the application.

With reference to FIG. 2, the application provides a display panel 1. The display panel 1 comprises two driver modules, each of which is provided with a driver chip 11 in a first direction X. Each driver chip drives a portion of a GOA circuit 12 in a second direction Y. Specifically, a first driver chip 11 drives a first GOA circuit 12, and a second driver chip 21 drives a second GOA circuit 22. The first GOA circuit 12 and the second GOA circuit 22 are disconnected at a particular location on the display panel 1, whereby the display panel 1 is divided into a first driver module and a second driver module, namely an upper driver module and a lower driver module, so as to increase the number of display lines of the display panel 1 and improve the time required to refresh a frame of display screen.

In an embodiment of the application, the second direction Y is perpendicular to the first direction X, wherein the second direction Y is a vertical direction and the first direction X is a horizontal direction.

In an embodiment of the application, the first driver module and the second driver module share a same data line, wherein the first driver module is a first gate driving module, and the second driver module is a second gate driving module. The gate between the first driver module and the second driver module is driven separately. At the corresponding positions on both ends of the display panel 1 where the first GOA circuit 12 and the second GOA circuit 22 are disconnected, scanning lines output at the same time, and corresponding thin film transistors are opened at the same time.

Further, the first driver module and the second driver module respectively drive the first GOA circuit 12 and the second GOA circuit 22 along the second direction Y, which serve as first stages for input of driving signals, and the first GOA circuit 12 and the second GOA circuit 22 are located close to one end of the first driver chip and the second driver chip, wherein a first stage GOA to which the first GOA circuit 12 inputs a driving signal is close to the first driver chip 11, and a first stage GOA to which the second GOA circuit 21 inputs a driving signal is close to the second driver chip. In other words, in the first driver module, the first stage GOA of the driving signal output by the first driver chip 11 is the first stage GOA closest to the first driver chip 11 in the first GOA circuit 12. In the second driver module, the first stage GOA of the driving signal output by the second driver chip 21 is the first stage GOA closest to the second driver chip 21 in the second GOA circuit 22.

In an embodiment of the application, the first GOA circuit 12 and the second GOA circuit 22 are disconnected at a central axis of the display panel 1 with respect to the second direction Y, wherein an area of the first driver module is equal to an area of the second driver module, and a length of the first GOA circuit 12 along the second direction Y is equal to a length of the second GOA circuit 22 along the second direction Y.

In an embodiment of the application, the display panel 1 is divided into a bending zone 1*a* and a non-bending zone 1*b*. The first GOA circuit 12 and the second GOA circuit 22 are disconnected at a location in the bending zone 1*a* of the display panel 1 in the second direction Y. An area of the first driver module is not equal to an area of the second driver module. The length of the first GOA circuit 12 along the second direction Y is not equal to the length of the second GOA circuit 22 along the second direction Y. The disconnect area where the first GOA circuit 12 and the second GOA circuit 22 are disconnected is placed in the bending zone 1*a*, which can improve display quality at the disconnect area of the display panel without affecting normal display operations.

Figure 4:
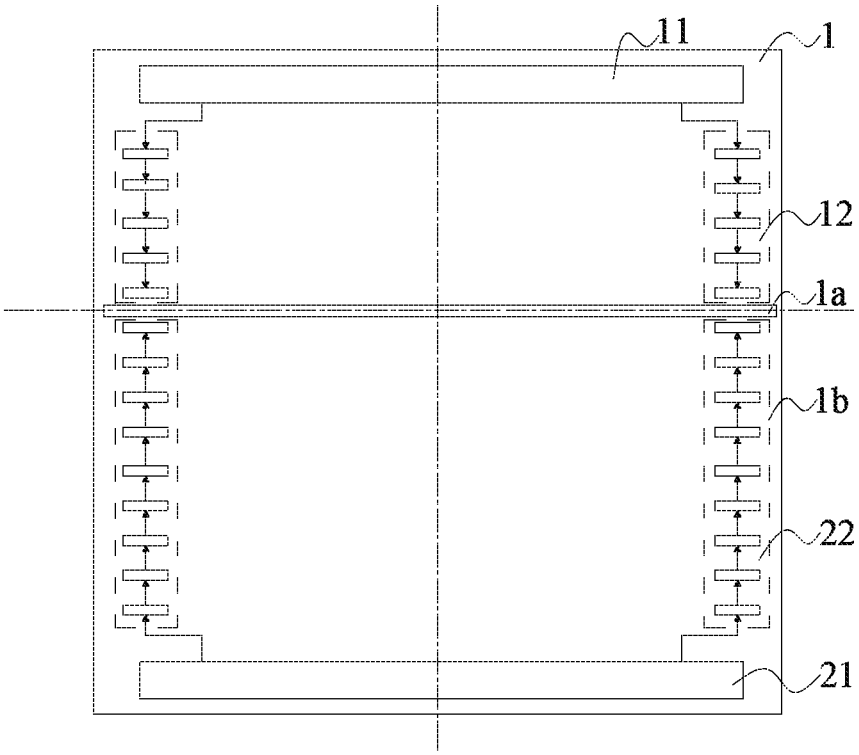
FIG. 4 is a third schematic diagram showing a structure of a display panel according to an embodiment of the application.

Refer to FIG. 4, in an embodiment of the application, the disconnect area where the first GOA circuit 12 and the second GOA circuit 22 are disconnected in the second direction Y is close to the first driver chip 11, wherein the area of the first driver module is less than the area of the second driver module, and the length of the first GOA circuit 12 along the second direction Y is shorter than the length of the second GOA circuit 22 along the second direction Y.

Figure 3:
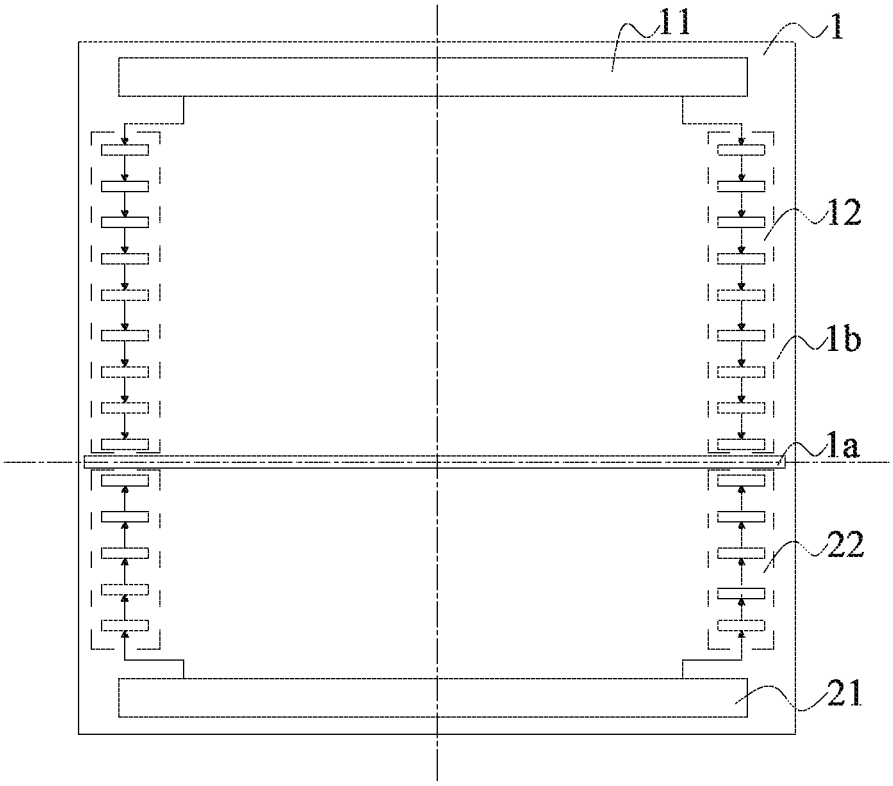
FIG. 3 is a second schematic diagram showing a structure of a display panel according to an embodiment of the application.

With reference to FIG. 3, in an embodiment of the application, the disconnect area where the first GOA circuit 12 and the second GOA circuit 22 are disconnected in the second direction Y is close to the second driver chip 21, wherein the area of the first driver module is greater than the area of the second driver module, wherein the length of the first GOA circuit 12 along the second direction Y is longer than the length of the second GOA circuit 22 along the second direction Y.

Figure 5:
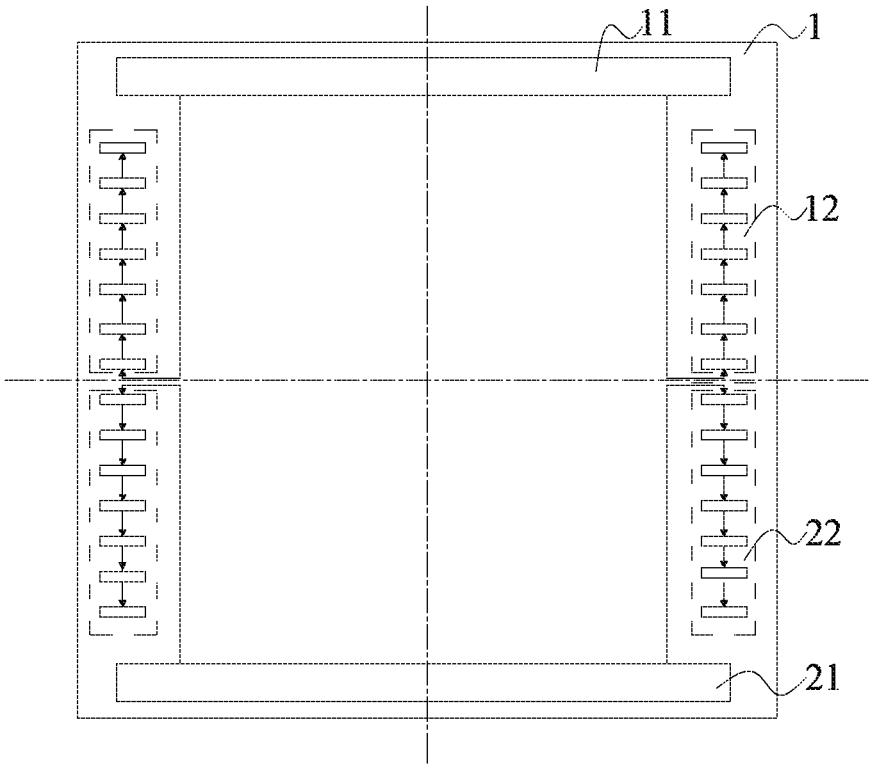
FIG. 5 is a fourth schematic diagram showing a structure of a display panel according to an embodiment of the application.

Refer to FIG. 5, the first driver module and the second driver module respectively drive the first GOA circuit 12 and the second GOA circuit 22 along the second direction Y, which serve as first stages for input of driving signals, and the first GOA circuit 12 and the second GOA circuit 22 are located away from one end of the first driver chip and the second driver chip 21, wherein a first stage GOA to which the first GOA circuit 12 inputs a driving signal is away from the first driver chip 11, and a first stage GOA to which the second GOA circuit 22 inputs a driving signal is away from the second driver chip 21. In other words, in the first driver module, the first stage GOA of the driving signal output by the first driver chip 11 is the first stage GOA most distant from the first driver chip 11 in the first GOA circuit 12; in the second driver module, the first stage GOA of the driving signal output by the second driver chip 21 is the first stage GOA most distant from the second driver chip 21 in the second GOA circuit 22.

Figure 6:
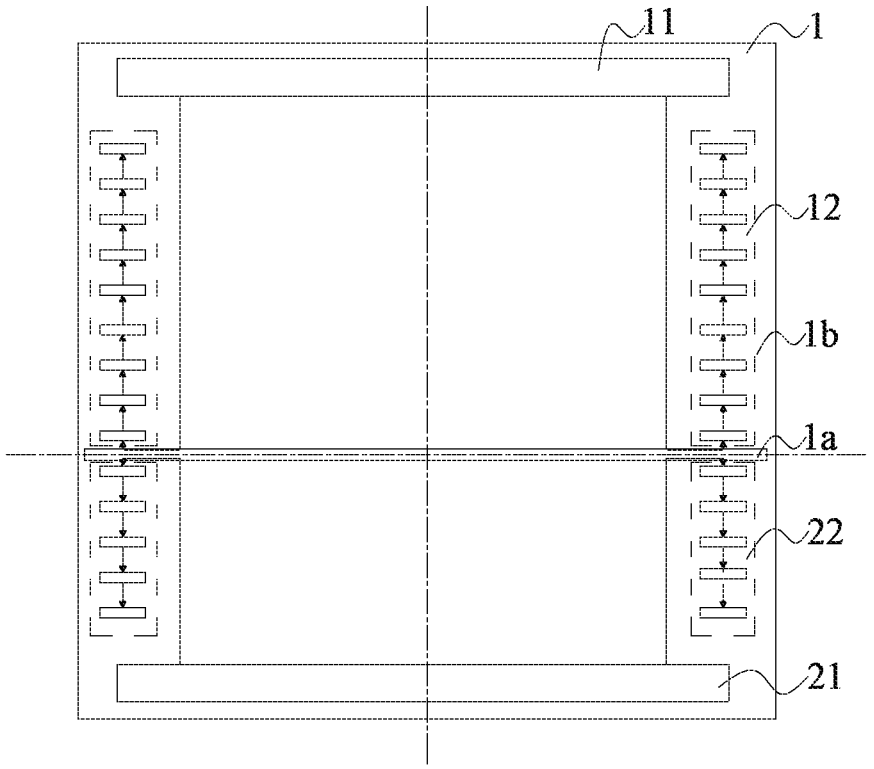
FIG. 6 is a fifth schematic diagram showing a structure of a display panel according to an embodiment of the application.
Figure 7:
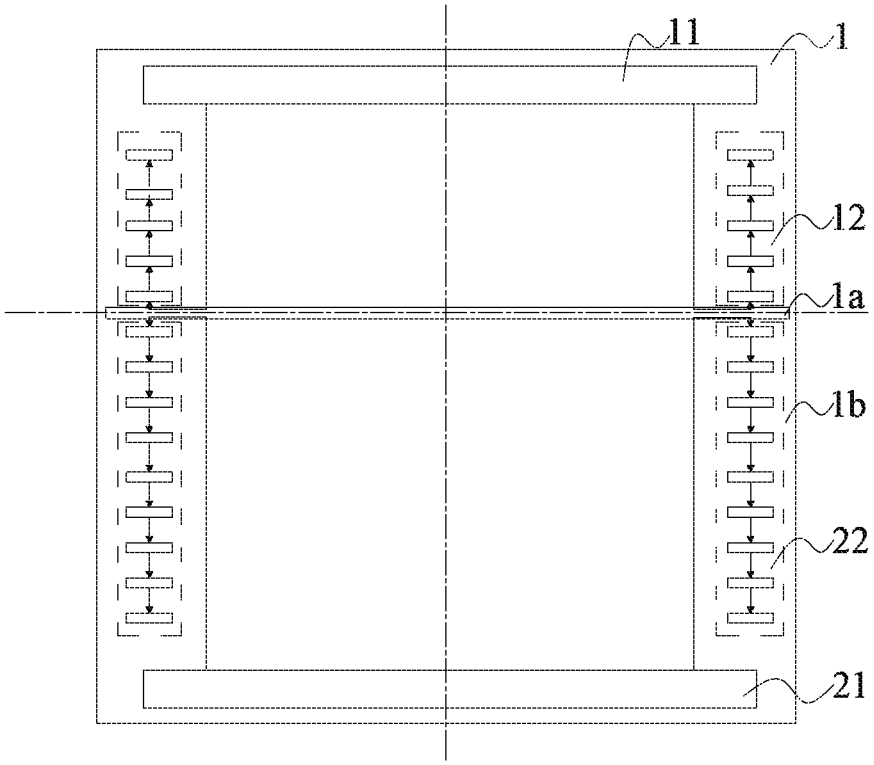
FIG. 7 is a sixth schematic diagram showing a structure of a display panel according to an embodiment of the application.

Similarly, when the first stage GOAs where the driving signal starts are the first stages most distant from the first driver chip 11 and the second driver chip 21, the disconnect area where the first GOA circuit 12 and the second GOA circuit 22 are disconnected may be located at a central axis of the display panel 1 with respect to the second direction Y, or in the bending zone 1*a*, as shown in FIG. 6 and FIG. 7.

Figure 8:
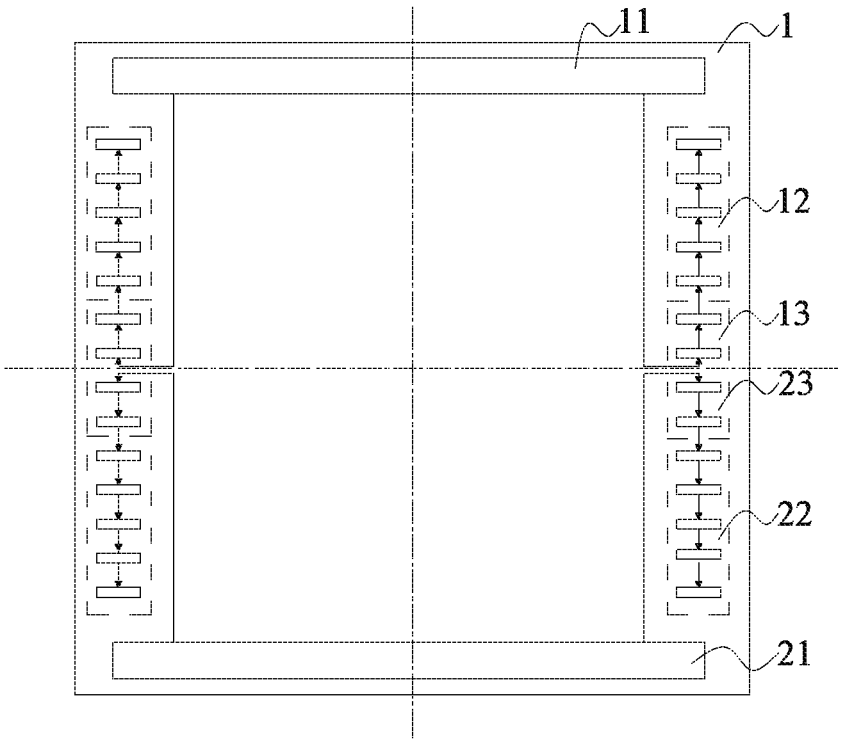
FIG. 8 is a seventh schematic diagram showing a structure of a display panel according to an embodiment of the application.

Further, with reference to FIG. 8, the first driver module includes at least one first virtual GOA circuit 13 which is located close to the disconnect area where the first GOA circuit 12 and the second GOA circuit 22 are disconnected. The second driver module includes at least one second virtual GOA circuit 23 which is located close to the disconnect area where the first GOA circuit 12 and the second GOA circuit 22 are disconnected. The arrangement is equivalent to increasing the load on the signal line of the GOA circuit to further stabilize the driving signal, reduce the difference between the driving signals, and prevent display abnormalities in the GOA disconnect area.

Further, in an embodiment of the application, the first driver module is provided with a first data line, and the second driver module is provided with a second data line. The first data line and the second data line are provided separately, so that in the first driver module and the second driver module, not only do the first GOA circuit and the second GOA circuit output from the upper and lower ends, respectively, but also the first data line and the second data line are output from the upper and lower ends, respectively.

Further, the first driver chip 11, the second driver chip 21, and the display panel 1 are packaged by chip on Pi (COP) or chip on film (COF) process. COP is a new display packaging process, and COP display package principle is to directly bend a part of the display to further narrow the display border and achieve a nearly borderless effect. Being especially improved for bendable displays, COP display packaging process are utilized for device models with a flexible OLED display. COF display packaging process integrates display driver chips on the flexible printed circuit board (FPCB) made up of the flexible materials, and bends the FPCB to the bottom of the display to further reduce the border and improve the proportion of the display area.

Compared with current technology, this application provides a display panel 1 with beneficial effects including: first, the display panel 1 provided in this application, wherein the display panel 1 comprises two driver modules, each of which is provided with a driver chip 11 in a first direction, each driver chip drives a portion of a GOA circuit in a second direction Y, wherein a first driver chip 11 drives a first GOA circuit 12, and a second driver chip 21 drives a second GOA circuit 22, the first GOA circuit 12 and the second GOA circuit 22 are disconnected at a particular location on the display panel 1. The display has an increased number of display lines, reducing the influence of signal delay on the display screen, and can achieve a high screen refresh rate and improve display quality. Further, the application provides a display panel 1, wherein the first GOA circuit 12 and the second GOA circuit 22 are disconnected at a central axis of the display panel 1 with respect to the second direction Y, or at a location in the bending zone 1*a* of the display panel 1 in the second direction. Better display quality at the disconnected portion of the display panel 1 is obtained without affecting normal operation of the display. Further, the application provides a display panel which includes the first driver module and the second driver module. Additionally, the first driver module and the second driver module respectively drive the first GOA circuit 12 and the second GOA circuit 22 along the second direction Y, which serve as first stages for input of driving signals, and the first GOA circuit 12 and the second GOA circuit 22 are located away from one end of the first driver chip 11 and the second driver chip 21, wherein a first stage GOA to which the first GOA circuit 12 inputs a driving signal is away from the first driver chip, and a first stage GOA to which the second GOA circuit 22 inputs a driving signal is away from the second driver chip. The first stage GOA for receiving a driving signal input at the disconnect area of the first driver module and the second driver module can reduce the signal difference between the two modules to prevent display abnormalities in the area where the GOA is disconnected, and to prevent distortion of GOA signals in the disconnect area after the GOA signals have undergone transmission in a cascade of the stages. Finally, the application provides a display panel 1 with a number of virtual GOA circuits 13 and 23 being provided at the disconnect area of the first driver module and the second driver module. The virtual GOA circuits 13 and 23 are connected in series with the first GOA circuit 12 in the first driver module and the second GOA circuit 22 in the second driver module, respectively, to increase load on the signal line, further stabilize the driving signals, reduce the difference between the driving signals, and prevent display abnormalities in the GOA disconnect area.

The display panel provided by the above embodiments of this application has been detailed in the foregoing description. In this article, the principles and embodiments of the application are expounded using specific individual examples, and explanation of the above embodiments are merely used to help understand technical solutions and core ideas of the application. A person with ordinary technical in the art should understand that he may modify the technical solutions described in the embodiments above, or equivalently replace some of the technical features thereof. Such modifications or substitutions with the corresponding technical solutions do not betray from the claims of the technical solutions of the embodiments of this application.

What is claimed is:

1. A display panel, wherein the display panel comprises a first driver module and a second driver module, each of which is provided with a driver chip that is located along an edge of the display panel in a first direction, each driver chip drives a GOA circuit located along two opposing edges of the display panel in a second direction, wherein a first driver chip that is located along a first edge of the display panel in the first direction drives a first GOA circuit that is located along the two opposing edges of the display panel in the second direction, a second driver chip that is located along a second edge of the display panel in the first direction drives a second GOA circuit that is located along the two opposing edges of the display panel in the second direction, the first edge is opposite to the second edge, and the first GOA circuit and the second GOA circuit are disconnected at a particular location of a bending zone on the display panel, the bending zone is located between the first edge and the second edge and separates the display panel into two opposing non-bending zones including a first non-bending zone and a second non-bending zone, the first driver chip and the first GOA circuit are located on and within an area of the first non-bending zone between the first edge and the bending zone, the second driver chip and the second GOA circuit are located on and within an area of the second non-bending zone between the second edge and the bending zone, wherein the first driver chip, the second driver chip, and the display panel are packaged using a COP or COF process;

wherein the first driver module drives the first GOA circuit along a direction from the bending zone to the first driver chip, the first GOA circuit comprises a first stage GOA for input of driving signals, the first driver chip is connected to the first stage GOA of the first GOA circuit, and the first stage GOA of the first GOA circuit is connected to remaining portions of the first GOA circuit in the direction from the bending zone to the first driver chip; and wherein the second driver module drives the second GOA circuit along a direction from the bending zone to the second driver chip, the second GOA circuit comprises a first stage GOA for input of driving signals, the second driver chip is connected to the first stage GOA of the second GOA circuit, and the first stage GOA of the second GOA circuit is connected to remaining portions of the second GOA circuit in the direction from the bending zone to the second driver chip.

2. The display panel of claim 1, wherein the second direction is perpendicular to the first direction.

3. The display panel of claim 1, wherein the first driver module and the second driver module share a same data line.

4. The display panel of claim 1, wherein the first GOA circuit and the second GOA circuit are disconnected at a central axis of the display panel with respect to the second direction, wherein an area of the first driver module is equal to an area of the second driver module.

5. The display panel of claim 1, wherein the display panel is divided into the bending zone and the two opposing non-bending zones, the first GOA circuit and the second GOA circuit are disconnected at a location of the bending zone of the display panel in the second direction, wherein an area of the first driver module is not equal to an area of the second driver module.

6. The display panel of claim 5, wherein the location where the first GOA circuit and the second GOA circuit are disconnected in the second direction is close to the first driver chip, wherein the area of the first driver module is less than the area of the second driver module.

7. The display panel of claim 5, wherein the location where the first GOA circuit and the second GOA circuit are disconnected in the second direction is close to the second driver chip, wherein the area of the first driver module is greater than the area of the second driver module.

8. The display panel of claim 1, wherein a location of the first stage GOA to which the first GOA circuit inputs a driving signal is more distant from the first driver chip in the direction from the bending zone to the first driver chip than a location of the remaining portions of the first GOA circuit from the first driver chip, and a location of the first stage GOA to which the second GOA circuit inputs a driving signal is more distant from the second driver chip in the direction from the bending zone to the second driver chip than a location of the remaining portions of the second GOA circuit from the second driver chip.

9. The display panel of claim 8, wherein the first driver module includes at least one first virtual GOA circuit which is connected in series and located close to the location where the first GOA circuit and the second GOA circuit are disconnected, and the second driver module includes at least one second virtual GOA circuit which is connected in series and located close to the location where the first GOA circuit and the second GOA circuit are disconnected.

10. A display panel, wherein the display panel comprises a first driver module and a second driver module, each of which is provided with a driver chip that is located along an edge of the display panel in a first direction, each driver chip drives a GOA circuit located along two opposing edges of the display panel in a second direction, wherein a first driver chip that is located along a first edge of the display panel in the first direction drives a first GOA circuit that is located along the two opposing edges of the display panel in the second direction, a second driver chip that is located along a second edge of the display panel in the first direction drives a second GOA circuit that is located along the two opposing edges of the display panel in the second direction, the first edge is opposite to the second edge, and the first GOA circuit and the second GOA circuit are disconnected at a particular location of a bending zone on the display panel;

the bending zone is located between the first edge and the second edge and separates the display panel into two opposing non-bending zones including a first non-bending zone and a second non-bending zone, the first driver chip and the first GOA circuit are located on and within an area of the first non-bending zone between the first edge and the bending zone, the second driver chip and the second GOA circuit are located on and within an area of the second non-bending zone between the second edge and the bending zone;

wherein the first driver module drives the first GOA circuit along a direction from the bending zone to the first driver chip, the first GOA circuit comprises a first stage GOA for input of driving signals, the first driver chip is connected to the first stage GOA of the first GOA circuit, and the first stage GOA of the first GOA circuit is connected to remaining portions of the first GOA circuit in the direction from the bending zone to the first driver chip; and wherein the second driver module drives the second GOA circuit along a direction from the bending zone to the second driver chip, the second GOA circuit comprises a first stage GOA for input of driving signals, the second driver chip is connected to the first stage GOA of the second GOA circuit, and the first stage GOA of the second GOA circuit is connected to remaining portions of the second GOA circuit in the direction from the bending zone to the second driver chip.

11. The display panel of claim 10, wherein the second direction is perpendicular to the first direction.

12. The display panel of claim 10, wherein the first driver module and the second driver module share a same data line.

13. The display panel of claim 10, wherein the first GOA circuit and the second GOA circuit are disconnected at a central axis of the display panel with respect to the second direction, wherein an area of the first driver module is equal to an area of the second driver module.

14. The display panel of claim 10, wherein the display panel is divided into the bending zone and the two opposing non-bending zones, the first GOA circuit and the second GOA circuit are disconnected at a location of the bending zone of the display panel in the second direction, wherein an area of the first driver module is not equal to an area of the second driver module.

15. The display panel of claim 14, wherein the location where the first GOA circuit and the second GOA circuit are disconnected in the second direction is close to the first driver chip, wherein the area of the first driver module is less than the area of the second driver module.

16. The display panel of claim 14, wherein the location where the first GOA circuit and the second GOA circuit are disconnected in the second direction is close to the second driver chip, wherein the area of the first driver module is greater than the area of the second driver module.

17. The display panel of claim 10, wherein a location of the first stage GOA to which the first GOA circuit inputs a driving signal is more distant from the first driver chip in the direction from the bending zone to the first driver chip than a location of the remaining portions of the first GOA circuit from the first driver chip, and a location of the first stage GOA to which the second GOA circuit inputs a driving signal is more distant from the second driver chip in the direction from the bending zone to the second driver chip than a location of the remaining portions of the second GOA circuit from the second driver chip.

18. The display panel of claim 17, wherein the first driver module includes at least one first virtual GOA circuit which is connected in series and located close to the location where the first GOA circuit and the second GOA circuit are disconnected, and the second driver module includes at least one second virtual GOA circuit which is connected in series and located close to the location where the first GOA circuit and the second GOA circuit are disconnected.

* * * * *